United States Patent [19]

Akselrad et al.

[11] 4,144,641

[45] Mar. 20, 1979

[54] CUTTING APPARATUS

[76] Inventors: Edward D. Akselrad, 505 Glen Malcolm Dr., Glenshaw, Pa. 15116; Stanley A. Akselrad, 226 Lexington Ave., Pittsburgh, Pa. 15215

[21] Appl. No.: 874,264

[22] Filed: Feb. 1, 1978

[51] Int. Cl.[2] ..... B65H 75/32; B26B 11/00

[52] U.S. Cl. ..... 30/289; 28/147; 242/48

[58] Field of Search ..... 242/48, 56 B; 30/124, 30/289; 28/147

[56] References Cited

U.S. PATENT DOCUMENTS

| | | | |
|---|---|---|---|
| 2,353,640 | 7/1944 | Bishop | 28/147 |
| 3,026,060 | 3/1962 | Norehad | 242/56 B |
| 3,042,329 | 7/1962 | Signorella | 242/48 |
| 3,783,478 | 1/1974 | Osterhout | 28/147 |
| 3,857,143 | 12/1974 | Montory | 30/289 X |

*Primary Examiner*—Jimmy C. Peters
*Attorney, Agent, or Firm*—Lloyd F. Engle, Jr.

[57] ABSTRACT

Apparatus for cutting yarn, cord, rope or any linear type material into a multiplicity of pre-determined desired lengths having a base with openings therein adapted to guide the material to be cut therethrough and into related partially helical grooves provided in said base, a material pulling means rotatably mounted on said base and comprising a spindle around which the material is wrapped and a clamping means for holding the leading end of said material, a cutting means fixedly mounted on said material pulling means and rotating therewith in relation to the said base, said cutting means having the rotatably described plane of its cutting edge proximately above the uppermost end of said partially helical grooves.

4 Claims, 4 Drawing Figures

CUTTING APPARATUS

This invention relates to apparatus for cutting yarn, cord, rope or any linear type material into a multiplicity of pre-determined desired lengths.

BACKGROUND OF THE INVENTION

Persons engaged in the utilization of twisted or braided fiber in a linear form, such as yarn, cord, twine or rope, as well as mono-filament linear material, have found it impossible to obtain such material in a multiplicity of pre-determined desired lengths. Even when such material has been obtainable in certain pre-cut lengths, not necessarily the length desired, the said pre-cut product is disproportionately more expensive than the uncut linear material in a continuous length.

For example, in the art of hooking rugs the practitioner utilizes yarn in cut lengths and engages each length of said yarn into the mesh backing to provide two strands of the upstanding nap. Heretofore, cut yarn in one length only, approximately two and one-half inches, has been obtainable commercially, but at a cost inordinately higher than yarn in a continuous length. When such practitioner desired to use cut yarn in different lengths, or to achieve economy, or both, it has been practice to wind yarn around some object of desired dimension and cut the windings transversely with scissors or other cutting device. This practice is laborious, time consuming, and does not always produce uniform pieces, on account of non-uniform tension in winding, inaccuracy in cutting, and the like. Further, there is a limitation on the number of pieces obtainable through one complete practice of the foregoing method of winding and cutting, and since rug hooking requires a great many pieces, the method must be repeated many times.

SUMMARY OF THE INVENTION

Accordingly, it is the purpose of this invention to provide an apparatus whereby a multiplicity of pre-determined desired lengths of linear material may be obtained for use or sale. The starting material, from which the pre-determined lengths of material are cut, comprises linear material of substantially great continuous length, such as a skein of yarn. The embodiments of the invention may vary greatly in size, so small as to be hand held and hand operated or so large as to be structurally mounted and motor driven, depending upon the pre-determined lengths of material desired to be obtained.

The circular base of the apparatus is provided with a plurality of sets of guide means which are similar but which are adapted to guide the linear material into different cutting positions, thereby to accomplish different cut lengths. Each single set of guide means is comprised in an initial material insert circular opening of larger diameter than the material to be cut, another partially circular opening proximately disposed inwardly and circumferentially from the first said circular opening, an irregular slot communicating with the second said partially circular opening and having its other end remotely disposed inwardly and circumferentially thereform in a raised circular boss in said base, and a partially helical groove in the upper surface of said raised circular boss and having its lowermost disposed end communicating and coinciding with the said remotely disposed end of the said irregular slot and its uppermost disposed end terminating in the upper or pressure cutting surface of said raised circular boss.

The material pulling means rotatably engages the said upper or pressure surface of said raised circular boss and is comprised in a cylindrical shank or spindle rotatably mounted upon said circular boss and having its lowermost surface in rotatable engagement with the said upper surface thereof, an arm extending radially from said shank or spindle and in fixed rotatable engagement therewith, a cutting means clampedly engaging said arm and having its cutting edge downwardly disposed proximate to but not engaging the said upper or pressure cutting surface of said boss, a material retaining means fixedly engaged to and depending downwardly from said arm in clamped engagement with the outwardly disposed end of said cutting means, and a material grasping means fixedly engaged to said arm and adapted to securely hold the leading end of the material to be cut. In the small, hand-operated embodiment of the invention, the said radially extending arm communicates at its outwardly disposed end with a rotatably mounted upstanding handle, thereby forming a crank for hand rotation of the material pulling means. In the larger, commercial embodiment of the invention the material pulling means is rotated by rotary drive means (not shown) of the conventional motor type and, therefore, the said upstanding handle is not required, although the radially extending arm is required along with its other communicating elements in order to provide the material grasping means, the material retaining means, and the material cutting means.

In operation of the invention, the leading end of the material to be cut is passed up through the first above mentioned circular opening of a selected guide means in the base, down through the said partial circular opening of said guide means, under the projection between same and the said remotely disposed end of the said irregular slot, up through said remotely disposed end of said irregular slot, along the said corresponding partial helical groove and under the said radially extending arm and the cutting edge of the cutting means inside the said material retaining means and around the said shank or spindle, and is inserted firmly in the material grasping means. With the linear material to be cut thusly threaded into the apparatus, rotation of said radially extending arm and said shank or spindle relative to said base draws said linear material through said guide means along said partially helical groove around said shank or spindle and under said cutting means, each successive revolution producing another turn of the material beneath the preceding turn and, thereby, continually displacing preceding turns upwardly on the shank or spindle and ultimately into full cutting engagement with the cutting means. When the first such turn of said material has been sufficiently displaced upward to be completely cut through by the cutting means, it will be obvious that the material grasping means will no longer be effective as part of the material pulling means to draw the material through the guide means. However, by the time this point of operation is reached, there is a build up of several turns of the material around the shank or spindle which are firmly held by the cutting edge of the cutting means and are in successive stages of being cut through thereby as a result of being displaced upward as each successive turn rises along the partially helical groove to the pressure cutting surface. Since all of the material to be cut on this apparatus is laterally compressible, some more and some less, there is always at least one complete turn of the material which has not been completely cut through. In the case of yarn, it is so highly compressible laterally that there are usually three or four turns of the material engaged by the cutting edge of the cutting means and being drawn over the pressure cutting surface. When such operating build up of material has been achieved, each revolution of the material pulling means produces one piece of material cut to the desired length which is the circumference of the shank or spindle selected to produce the desired pre-determined length. Accordingly, it will be seen that it is desirable that the space relation between the cutting edge of the cutting means and the pressure cutting surface of the raised circular boss be less than the uncompressed diameter of the linear material being cut. While this distance is not critical and can operably exceed the diameter of highly compressible material being cut such as yarn, it can be critical when less compressible material, such as plastic mono-filament, is being cut.

The invention provides versatility in the different desired pre-determined lengths of material which may be produced by a single apparatus. For example, the embodiment shown in the drawings will produce cut material of three different lengths, which has been found to be adequate differential for the hand held embodiment for use in such process as producing cut yarn for hooking rugs. This versatility is accomplished by providing three separate guide means circumferentially equally disposed one from the other and providing a corresponding spindle diameter for use with each separate guide means. It will be seen that the guide means are similar, the only difference being the distance from the center of the base to the inwardly disposed end of the irregular slot where it terminates in the lowermost end of its corresponding separate partially helical groove. The separate corresponding spindle diameters are accomplished by using the fabricated shank or spindle of the material pulling means in cooperation with the particular guide means which incorporates the partially helical groove of smallest diameter, providing a partially slotted cylindrical cap which is slip fitted over said fabricated shank or spindle and is secured thereto by the wing nut on the pulling means pivotal bolt to cooperate with the partially helical groove of next largest diameter, and providing still another partially slotted cylinder cap of larger diameter placed and secured in the same way over the previously mentioned cap to cooperate with the partially helical groove of largest diameter. With this embodiment cut lengths in the order of 2.5 inches, 3.5 inches, and 4.5 inches, respectively, can be produced and this range has been selected to adequately fit the desired lengths of practitioners in the art of rug hooking. It will be obvious, however, that numerous lengths can be produced with other embodiments of the invention by merely varying the relative sizes of the cooperating components, the length of the cut piece always being the circumference of the spindle or spindle adapter being utilized. It is important that the outside diameter of the spindle or spindle adapter being used correspond proximately to and be not greater than the inside diameter of the cooperating partially helical groove and that the downwardly disposed end of the spindle or spindle adapter be in rotatably slidable engagement with the uppermost disposed surface or pressure cutting surface of the raised circular boss with no space therebetween, lest the linear material be pulled under the edge of the spindle or spindle adapter, thereby rendering it incapable of being upwardly displaced by successive windings and into engagement with the cutting edge of the cutting means.

The cutting means is basically a thin knife blade clampedly engaged to the radially extending arm of the material pulling means and having its cutting edge disposed downwardly in proximate spaced relation to the uppermost disposed surface or pressure cutting surface of the raised circular boss. The embodiment of the invention shown in the drawings utilizes a double edge razor blade of familiar universally marketed type which is clampedly secured between the split sections of the radially extending arm and is further secured thereto by nipples on one of the said split sections adapted to fit through the standard openings in such razor blade and into corresponding receptacles in the oppositely disposed section, the said sections being clampedly secured with the said blade therebetween by a bolt passing therethrough and through the center of the said razor blade. Such adaptation permits the user of this embodiment of the invention to turn the said razor blade over and utilize the other cutting edge when the first used edge becomes dull.

DESCRIPTION OF THE PREFERRED EMBODIMENT

Figure 3:
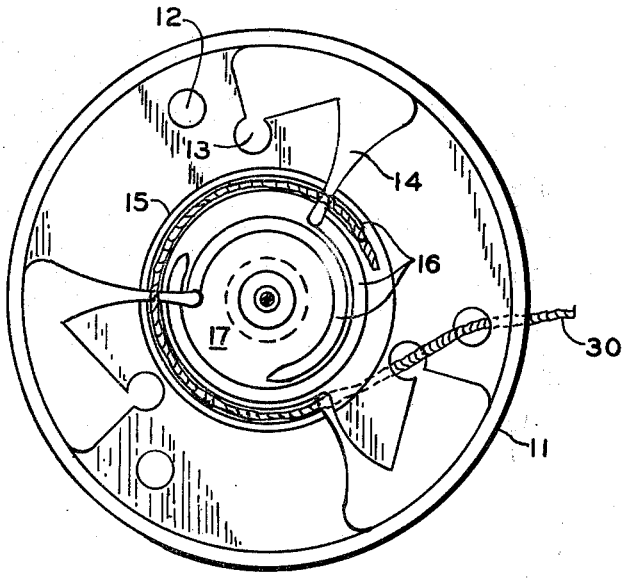
FIG. 3 is a cross-sectional plan view taken along plane 3—3 of FIG. 2 and showing the linear material threaded through one of the guide means.
Figure 2:
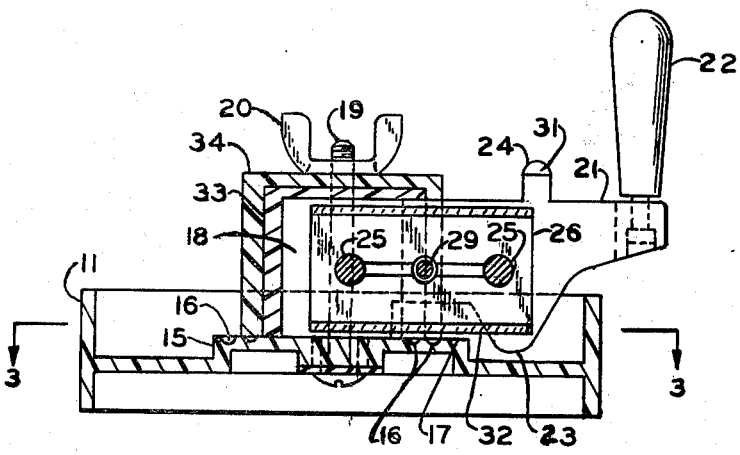
FIG. 2 is a cross-sectional side view taken along plane 2—2 of FIG. 1.
Figure 4:
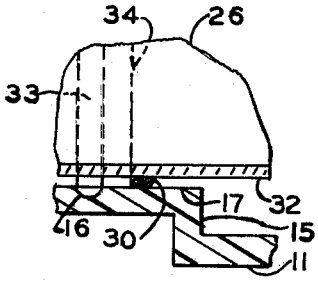
FIG. 4 is an enlarged fragmentary cross-section taken along plane of the blade and showing the linear material in position for cutting.
Figure 1:
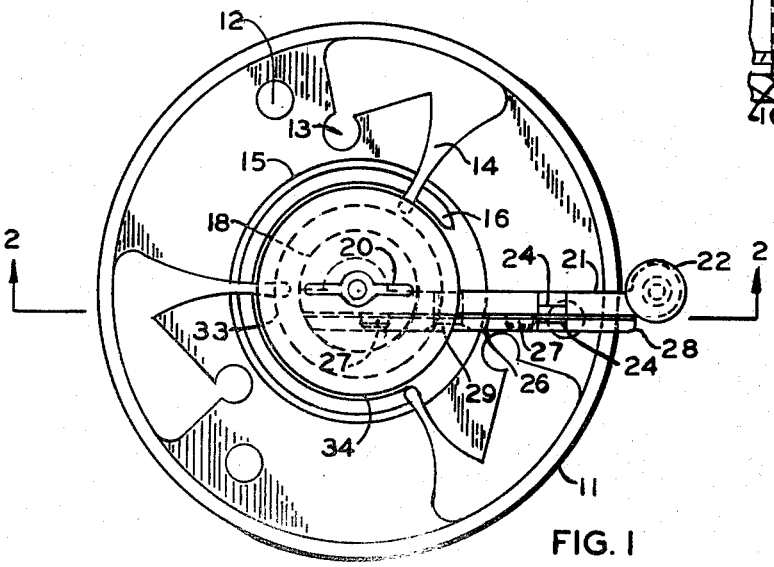
FIG. 1 is a plan view of the cutting apparatus.

Referring to FIG. 1, a base 11 includes a plurality of guide means, each comprised in a circular initial insert opening 12, a partial circular opening 13, an irregular slot 14, and a raised circular boss 15 having a partially helical groove 16 in its upper or pressure-cutting surface 17. The shank or spindle 18 of the material pulling means is rotatably engaged to the pressure cutting surface 17 of the raised circular boss 15 by the bolt 19 and nut 20. A radially extending arm 21 is fixedly engaged to the spindle 18 and has an upstanding crank handle 22 rotatably mounted proximate its outwardly disposed end. A portion of the material retaining means 23 depends downwardly from the arm 21 and a portion of the material grasping means 24 extends upwardly therefrom. Nipples 25 project laterally from the arm 21 and the spindle 18 through standard openings in razor blade 26 and into receptacles 27 in the clamping plate 28 which is fixedly engaged to the arm 21, with the blade 26 therebetween, by countersunk screw 29. The clamping plate 28 is similar in configuration to a portion of arm 21, in that it also has the matching downwardly depending portion of the material retaining means 23 and the matching upwardly extending portion of the material grasping means 24. The blade 26 between the arm 21 and the plate 28 causes a separation equal to the thinckness of the blade 26 when said parts are all in clamped assembly. Said separation results in a space between the portions of grasping means 24 extending upward from each outside element of said clamped assembly, into which space the linear material 30 to be cut is readily inserted by the operator as a result of providing an outwardly divergent chamfer 31 on the uppermost end of the inwardly disposed face of each portion of the grasping means 24.

The cutting edge 32 of the blade 26 is disposed upwardly from and not in engagement with the pressure cutting surface 17 of boss 15 a distance not substantially greater than the uncompressed diameter of the linear material 30 and not less than the compressed diameter of said linear material 30. The outside diameter of the spindle 18 corresponds to the inside diameter of the smallest of the grooves 16.

Cylindrical cap 33 is partially slotted longitudinally in one of its sides on a chord offset from its axis, said offset and slot width corresponding to the position of and adapted to slidably engage the outwardly disposed sides of the crank assembly comprised in the arm 21, the blade 26 and the clamping plate 28. The inside diameter of cap 33 is such as to provide a slidable fit over spindle 18 and its outside diameter corresponds to the inside diameter of the mid-sized groove 16. A hole is provided in the center of the top of cap 33 to accommodate bolt 19 and when in place, it is secured by nut 20.

Cylindrical cap 34 is constructed in much the same way as cap 33 and has the same size slot at the same offset position. The inside diameter of cap 34 is such as to provide a slidable fit over cap 33 and its outside diameter corresponds to the inside diameter of the largest groove 16. A hole is also provided in the center of the top of cap 34 to accomodate bolt 19 and, when in place, it is secured by nut 20.

In operation of the apparatus, the operator predetermines the desired lengths of the cut material to be produced and thereby selects the corresponding combinations of spindle 18 and caps 33 and 34, securing the desired combination in place by bolt 19 and nut 20. Then, selecting the guide means which corresponds to the said selected combination of spindle 18 and caps 33 and 34, the operator feeds the end of the linear type material 30, such as a skein of yarn, upward through opening 12, downward through opening 13, upward through the inwardly disposed end of irregular slot 14, along groove 16, inside retaining means 23, under blade 26, upwards adjacent clamping plate 28, and inserts it between the components of grasping means 24. It will be seen that the material to be cut can be looped under the projection between opening 13 and the inwardly disposed end of irregular slot 14, since the embodiment shown in the drawings incorporates communication between them. This provision is made for ease of insertion of the material and it will be seen that the apparatus is equally functional without said communication.

Greater or lesser size of the apparatus, and more or less guide means and cap combinations, and the application of rotary motor power instead of manual operation do not alter the basic function and versatility of the apparatus.

What is claimed is:

1. A cutting device for linear type material comprising a base with guide means adapted to direct the material therethrough and upward onto a pressure cutting surface on the upwardly disposed plane of a raised boss concentrically engaging said base, a material pulling means rotatably engaging the said upwardly disposed plane of said raised boss and in concentric relation therewith and comprising a rotatable spindle with radially extending crank arm fixedly engaging said spindle and having material retaining and material grasping means thereon, and a cutting means clampedly engaging said crank arm and adapted to rotate therewith and having its cutting edge in proximate spaced relation to and upwardly disposed from said cutting surface.

2. The apparatus of claim 1 wherein the guide means is comprised in an opening through said base outwardly disposed from said raised boss adapted to accommodate slidable passage of the linear material to be cut, another opening through said base outwardly disposed from said raised boss but more proximate thereto than the first said opening adapted to accommodate slidable passage of the linear material to be cut, an irregular slot through said base and said boss communicating with second said opening and having its innermost disposed end inwardly disposed in said boss and adapted to accommodate slidable passage of the linear material to be cut, and a partial helical groove in the upper surface of said boss with its lowermost disposed end communicating with said innermost disposed end of said irregular slot and its uppermost disposed end terminating in the said upper surface of said boss and adapted to accommodate slidable passage of the linear material to be cut.

3. The apparatus of claim 1 having a plurality of said guide means differentiated only by differing diameters of said partial helical grooves and corresponding communication thereto of said innermost disposed ends of said irregular slots.

4. The apparatus of claim 1 having a plurality of said material pulling means adapted to increase the diameter of said spindle with a series of partially slotted caps slidably engaging said spindle longitudinally but fixedly engaging said spindle rotatably and having outside diameters coinciding with the inside diameters of said plurality of partial helical grooves.

* * * * *